US006419444B1

(12) United States Patent
Kabasawa et al.

(10) Patent No.: US 6,419,444 B1
(45) Date of Patent: Jul. 16, 2002

(54) SCREW GROOVE TYPE VACUUM PUMP, COMPLEX VACUUM PUMP AND VACUUM PUMP SYSTEM

(75) Inventors: Takashi Kabasawa; Manabu Nonaka, both of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/572,743

(22) Filed: May 16, 2000

(51) Int. Cl.[7] ..... F04D 3/02
(52) U.S. Cl. ..... 415/72; 415/73; 415/90
(58) Field of Search ..... 415/72, 73, 75, 415/90; 416/176, 177

(56) References Cited

U.S. PATENT DOCUMENTS 4,708,586 A * 11/1987 Sawada et al. ..... 415/72
6,217,278 B1 * 4/2001 Shiokawa et al. ..... 415/90

FOREIGN PATENT DOCUMENTS

JP 403168388 A * 7/1991

* cited by examiner

*Primary Examiner*—Edward K. Look
*Assistant Examiner*—Ninh Nguyen
(74) *Attorney, Agent, or Firm*—Adams & Wilks

(57) ABSTRACT

A screw groove-type pump has a rotor member mounted for undergoing rotation, a stator member arranged so as to be coaxial with the rotor member and having a peripheral wall disposed opposite to and spaced-apart from a circumferential wall of the rotor member, an inlet port for introducing gas into a space between the circumferential wall of the rotor member and the peripheral wall of the stator member, and an outlet port for discharging gas introduced into the space between the circumferential wall of the rotor member and the peripheral wall of the stator member. A screw groove is formed on one of the circumferential wall of the rotor member and the peripheral wall of the stator member for transferring gas introduced into the inlet port through the space between the circumferential wall of the rotor member and the peripheral wall of the stator member and to the outlet port during rotation of the rotor member. The depth of the screw groove at a point thereof which is nearest the inlet port is equal to or larger than ¼ the diameter of one of the circumferential wall of the rotor member and the peripheral wall of the stator member. An angle of elevation of the screw groove with respect to a radial axis of the rotor member decreases toward the outlet port from the inlet port.

32 Claims, 4 Drawing Sheets

SCREW GROOVE TYPE VACUUM PUMP, COMPLEX VACUUM PUMP AND VACUUM PUMP SYSTEM

BACKGROUND OF THE INVENTION

1. Field of the Invention

The present invention relates to a screw groove type vacuum pump, and a complex pump and a vacuum pump system both of which include the screw groove type vacuum pump. More specifically, the present invention relates to a screw groove type vacuum pump, a complex pump and a vacuum pump system with which excellent exhaust speed can be attained.

2. Description of the Related Art

Screw groove type vacuum pumps have conventionally been well known. Any of these screw groove type vacuum pumps is provided with a rotor member that rotates and a stator member fixedly arranged so as to be coaxial with the rotor member, and has a screw groove formed on one of a circumferential wall of the rotor member and an opposite wall of the stator member which is opposite to the circumferential wall. The rotor member is rotated to introduce gas from an inlet port into the screw groove and to then transfer the gas along the screw groove, thereby discharging the gas through an outlet port.

In the screw groove type vacuum pump as such, conventionally, a screw sealing technique or the like is applied and the screw groove is designed so as to be rather shallow in order to efficiently transfer with the rotation of the rotor member gas molecules whose pressure is of a viscous flow region while utilizing the viscosity, and to thereby prevent the backward-flow from the outlet port side to the inlet port side.

However, conventional screw groove type vacuum pumps as described above have a problem of slow exhaust speed, for the average free path of gas molecules is large for gas in a molecule flow region and hence it is difficult to introduce the gas into the screw groove.

There has been proposed as a technique for improving the gas exhaust speed a screw groove type vacuum pump in which the screw groove at the inlet port is set deep and the depth of the screw groove is sharply reduced from thereon. In this screw groove type vacuum pump, the intake area of gas that is taken from the inlet port into the screw groove is large making it easy to introduce the gas in the molecule flow region into the screw groove.

On the side downstream of the inlet port, however, the pressure of the gas to be transferred through the screw groove is of an intermediate flow region between the molecule flow region and the viscous flow region, and the average free path of gas molecules is relatively large. For that reason, the gas molecules taken in are reflected by the bottom of the screw groove, or the like, which means that a sufficient exhaust speed cannot be obtained by merely setting the screw groove deeper at the inlet port.

The present inventors have found that, in a screw groove type vacuum pump, the pressure of the gas to be transferred through the screwed groove maintains the pressure of the intermediate flow region between the molecule flow region and the viscous flow region downstream of the inlet port until the gas reaches a certain depth of the pump in the axial direction, and that setting the flow path wider at this certain depth and securing the sealing from thereon result in prevention of reflection and backward flow of gas molecules, prevention of degradation of sealing, improved gas exhaust efficiency and excellent exhaust speed.

SUMMARY OF THE INVENTION

The present invention has been made on the basis of the findings as above, and an object of the present invention is therefore to provide a screw groove type vacuum pump, a complex vacuum pump and a vacuum pump system with which excellent exhaust speed can be attained.

In order to achieve the above object, the present invention provides a screw groove type vacuum pump comprising: a rotor member that rotates; a stator member fixedly arranged so as to be coaxial with the rotor member and having an opposite wall that is opposite to a circumferential wall of the rotor member; an inlet port for introducing gas into a space between the circumferential wall of the rotor member and the opposite wall of the stator member; and an outlet port for discharging the gas from the space between the circumferential wall of the rotor member and the opposite wall of the stator member, in which: a screw groove for transferring the gas from the inlet port with the rotation of the rotor member is formed on one of the circumferential wall of the rotor member and the opposite wall of the stator member; the depth of the screw groove at the nearest point to the inlet port is 20 mm or more, or is equal to or larger than ¼ the diameter, including the screw groove, of one of the circumferential wall of the rotor member and the opposite wall of the stator member, the depth of the screw groove is decreased toward the outlet port side from the inlet port side, and the depth of the screw groove in a region defined by the inlet port and a point on the rotor member which is 40 mm in the axial direction is 80% or more of the depth at the nearest point to the inlet port; and the slant of the screw groove with respect to the radial direction of the rotor member is decreased toward the outlet port side from the inlet port side, and maintains to be 80% or more of the slant at the inlet port until the thread reaches a point on the rotor member which is at least 40 mm in the axial direction.

According to the above screw groove type vacuum pump of the present invention, the depth of the screw groove may be decreased toward the outlet port side, which is downstream of a region defined by the inlet port and the point on the rotor member which is 40 mm in the axial direction, in proportion to the distance in the axial direction. This makes it possible to transfer gas in a viscous flow region with tight sealing.

The slant of the screw groove may be decreased toward the outlet port side, which is downstream of a region defined by the inlet port and the point on the rotor member which is 40 mm in the axial direction, in proportion to the distance in the axial direction. This makes it possible to transfer gas in the viscous flow region with tight sealing.

The slant of the screw groove may be decreased toward the outlet port side, which is downstream of a region defined by the inlet port and the point on the rotor member which is 40 mm in the axial direction, in logarithmic proportion to the distance in the axial direction. This makes it possible to transfer gas in the viscous flow region with tight sealing.

In order to achieve the above object, the present invention also provides a complex vacuum pump including the above screw groove type vacuum pump of the present invention.

In order to achieve the above object, the present invention also provides a vacuum pump system comprising the above screw groove type vacuum pump of the present invention and an auxiliary pump for taking in gas discharged through the outlet port of the screw groove type vacuum pump.

In order to achieve the above object, the present invention also provides a vacuum pump system comprising the above screw groove type vacuum pump of the present invention and an auxiliary pump for taking in gas discharged through the outlet port of the screw groove type vacuum pump that is included in the complex vacuum pump.

DETAILED DESCRIPTION OF THE PREFERRED EMBODIMENTS

Hereinafter, a description will be given in detail of preferred embodiments of the present invention with reference to FIGS. 1 to 4.

Figure 1:
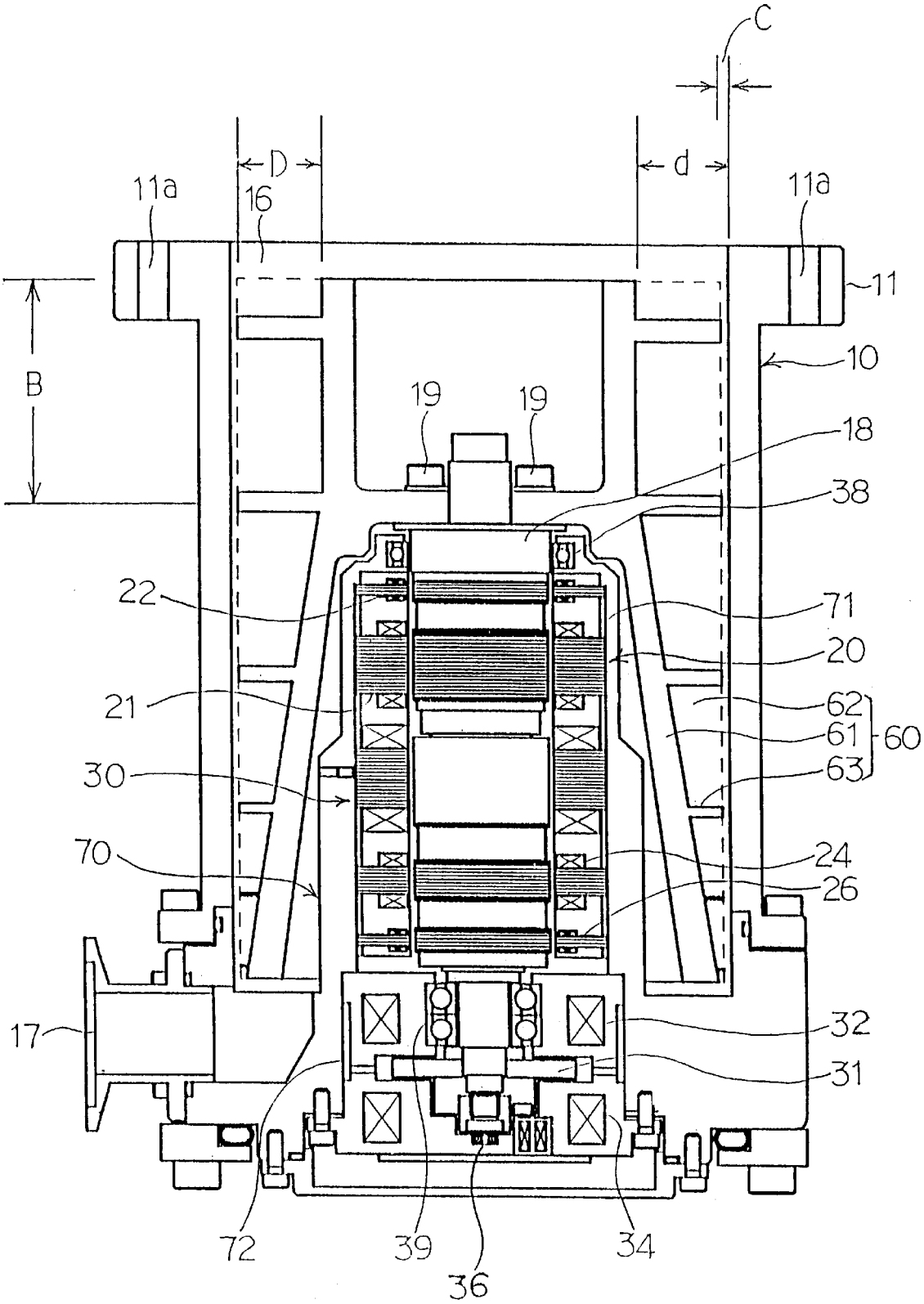
FIG. 1 is a sectional view showing the entire structure of a screw groove type vacuum pump according to an embodiment of the present invention.

FIG. 1 is a sectional view showing the entire structure of a screw groove type vacuum pump according to an embodiment of the present invention.

The screw groove type vacuum pump according to this embodiment is comprised of, as shown in FIG. 1, a rotor shaft 18 shaped like a column, a rotor 60 as a rotor member that is fixedly arranged on the rotor shaft 18 and rotates together with the rotor shaft 18, and a casing or an exterior member 10 and a stator 70 which serve as a stator member.

The exterior member 10 has a cylindrical shape whose diameter does not vary over the entire length in the axial direction, and the rotor shaft 18 is coaxially arranged in the center of the exterior member 10.

The exterior member 10 has at its upper end a flange 11 elongated outward in the radial direction. The flange 11 has bolt holes 11*a* drilled therein in a direction parallel to the axis. This flange 11 is fastened to, for example, an apparatus for manufacturing semiconductors with bolts or the like to connect an inlet port 16 formed inside the flange 11 to an outlet port of a vessel, e.g., a chamber, so that the interior of the vessel is communicated with the interior of the exterior member 10.

The rotor shaft 18 is supported by a magnetic bearing 20 with a magnetic force, and is rotated with a driving force transmitted from a motor 30. The stator 70 is provided with a tubular portion 71 that surrounds the rotor shaft 18 and is shaped like a tube and a base portion 72 to which the tubular portion 71 is fixed at an upper part.

The magnetic bearing 20 is a 5-axes-control type magnetic bearing, and is provided with: radial electromagnets 21, 24 for generating a magnetic force in the radial direction of the rotor shaft 18 in the vicinity of the upper and lower ends of the rotor shaft 18; radial sensors 22, 26 for detecting the position of the rotor shaft 18 in the radial direction; axial electromagnets 32, 34 for generating a magnetic force in the axial direction of the rotor shaft 18; a metal disc 31 upon which the magnetic force in the axial direction, generated by the axial electromagnets 32, 34, acts; and an axial sensor 36 for detecting the position of the rotor shaft 18 in the axial direction.

The radial electromagnets 21, 24 each include two pairs of electromagnets arranged on the tubular portion 71 of the stator 70 such that one pair is perpendicular to the other pair. The electromagnets in each pair are arranged so as to face one another with the rotor shaft 18 interposed therebetween. An excitation current is supplied to these radial electromagnets 21, 24 to float the rotor shaft 18 with a magnetic force.

Outside the radial electromagnets 21, 24 in the thrust direction, two paris of the radial sensors 22 and two pairs of the radial sensors 26 are arranged on the tubular portion 71 of the stator 70 such that the two pairs of the radial sensors 22 and the two pairs of radial sensors 26 are arranged with one pair being perpendicular to the other pair, corresponding to the radial electromagnets 21, 24. Two sensors in each sensor pair face one another with the rotor shaft 18 interposed therebetween. The control of the excitation current supplied to the radial electromagnets 21, 24 is made, when the shaft is floated with a magnetic force, in response to position detection signals sent from the radial sensors 22, 26, to thereby keep the rotor shaft 18 at a predetermined position in the radial direction.

The metal disc 31 made of a magnetic member and shaped like a disc is fixed to a lower of the rotor shaft 18. A pair of the axial electromagnets 32 and a pair of the axial electromagnets 34 are arranged on the base portion 72 of the stator 70 such that the electromagnets 32 face the, electromagnets 34 with the metal disc 31 interposed therebetween. The axial sensor 36 is arranged on the base portion 72 of the stator 70 while being opposed to the lower end of the rotor shaft 18.

An excitation current flowing through the axial electromagnets 32, 34 is controlled in response to a position detection signal sent from the axial sensor 36, to thereby keep the rotor shaft 18 at a predetermined position in the axial direction.

It is possible for the vacuum pump to be driven in a clean environment, for the employment of the magnetic bearing 20 eliminates any mechanical contacts to produce no dust, and dispenses the pump of oils such as a sealing oil to generate no gas. The screw groove type vacuum pump according to this embodiment is thus suitable for an application in which a high cleanness is required as in manufacture of semiconductors.

The screw groove type vacuum pump according to this embodiment also has touch down bearings 38, 39 arranged on an upper part and on a lower part of the rotor shaft 18, respectively.

Usually, the rotor unit comprising the rotor shaft 18 and the parts attached to the shaft is, while being rotated by the motor 30, axially supported by the magnetic bearing 20 without coming into contact with the bearing. The touch down bearings 38, 39 are bearings for protecting the entire pump by axially supporting the rotor unit instead of the magnetic bearing 20 when the touch down takes place.

Accordingly, the touch down bearings 38, 39 are arranged so that their inner rings do not come into contact with the rotor shaft 18.

The motor 30 is arranged almost in the middle between the radial sensors 22 and 26, inside the exterior member 10, in the axial direction of the rotor shaft 18. The motor 30 is energized to rotate the rotor shaft 18 as well as the rotor 60 that is attached to the shaft.

The rotor 60 is comprised of a rotor body 61 having a sectional shape like an inverted letter U and arranged on the outer periphery of the rotor shaft 18, and a screw thread 63 elongated outward from the outer peripheral surface of the rotor body 61. This rotor body 61 is attached to the top of the rotor shaft 18 with bolts 19.

Figure 2:
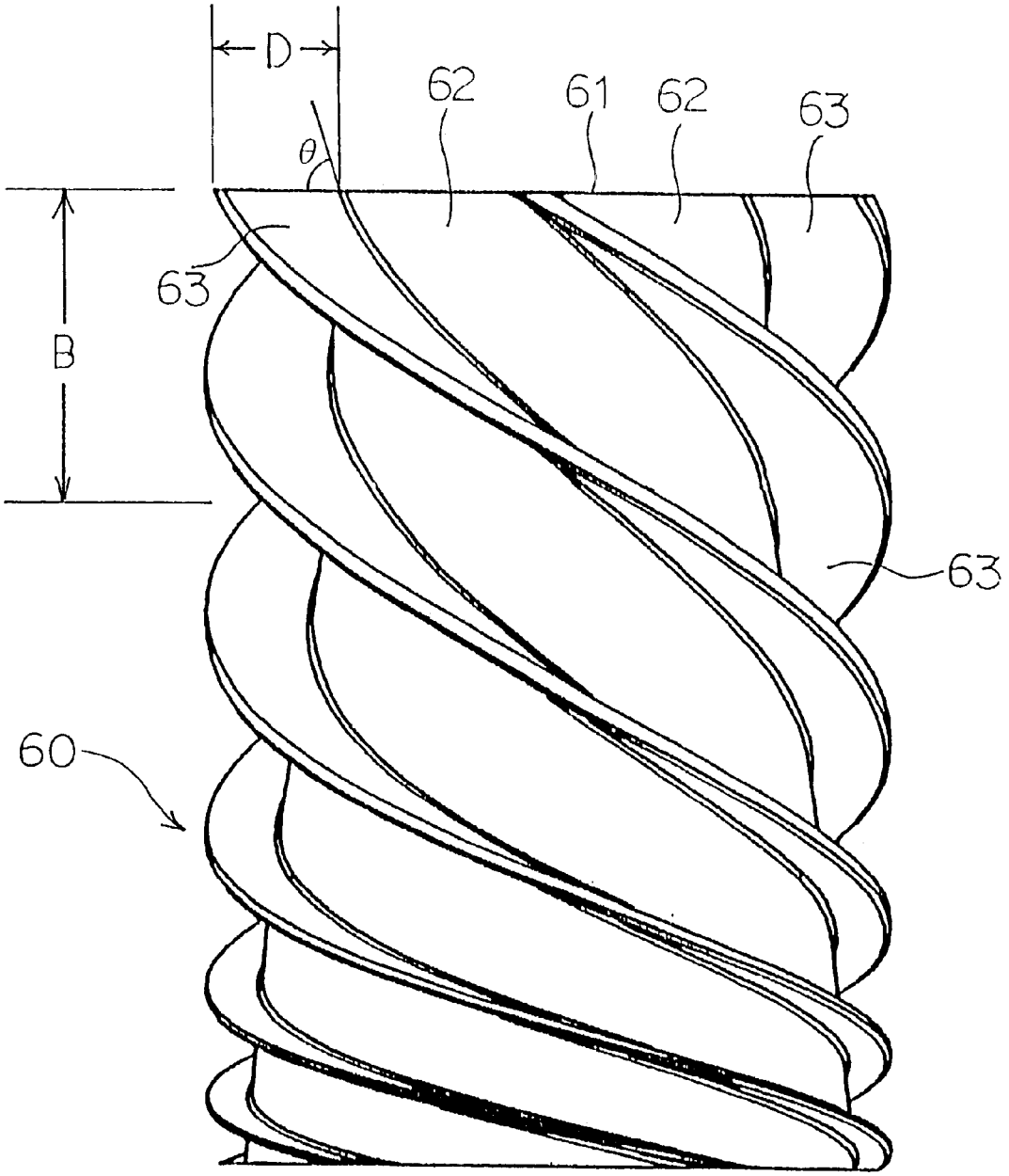
FIG. 2 is a side view showing a rotor body of the screw groove type vacuum pump in FIG. 1.
Figure 3:
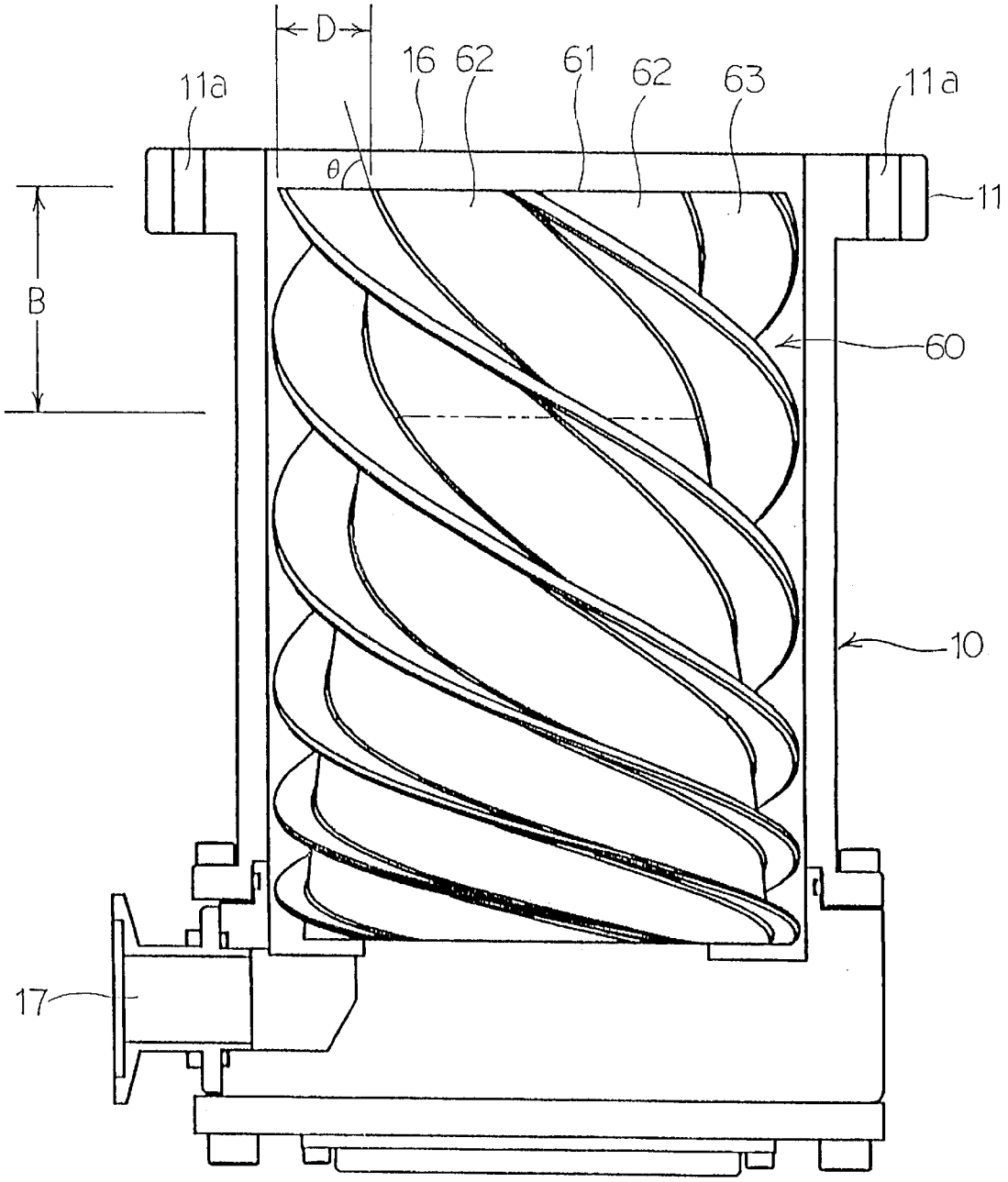
FIG. 3 is an internal side view showing a state where a rotor body 61 of the screw groove type vacuum pump in FIG. 1 is attached to a rotor shaft.

FIG. 2 is a side view of the rotor body 61, and FIG. 3 is an internal side view showing a state in which the rotor body 61 is attached to the rotor shaft 18.

As shown in FIG. 2, the screw thread 63 of the rotor 60 is helically formed of plural threads so as to be coaxial with the axis of the rotor body 61 on the outer peripheral surface of the rotor body 61. The space between the threads of the screw thread 63 is a screw groove 62. As shown in FIG. 3, the rotor 60 is fixed to the rotor shaft 18, and the edge face of the screw thread 63 faces the inner circumferential wall of the exterior member 10 with a gap that may be deemed as invariable over the entire length of the rotor body.

The screw groove 62 is communicated with the inlet port 16 so that gas from the chamber is introduced into the screw groove 62. The screw groove 62 has at the nearest point to the inlet port 16 a depth D (distance from the free edge face of the screw thread 63 down to the outer peripheral surface of the rotor body 61) of 20 mm or more. The slant θ with respect to the radial direction of the rotor 60 (an angle of elevation) of the screw groove 62 is 20 to 40° at the nearest point to the inlet port 16.

The diameter of the rotor body 61 is increased downstream (toward the outlet port 17 side), as the distance from the inlet port 16 is increased, protruding to the inner circumferential wall of the exterior member 10. The screw groove 62 is adapted to this increase in diameter of the rotor body 61 and the depth D of the groove is made shallow. The slope of the screw thread 63 with respect to the radial direction becomes gentle as it distances itself from the inlet port 16 and approaches the outlet port 17, and the angle of elevation θ of the screw groove 62 accordingly takes a smaller value.

From the inlet port 16 to a point on the rotor body 61 which is 40 mm in the axial direction (in a range indicated by reference symbol B in the drawing), the depth D and the angle of elevation θ of the screw groove 62 are gently and continuously decreased but maintain to be 80% or more of the depth D and the angle of elevation θ at the inlet port 16. The ratio of a distance d from the bottom of the screw groove 62 to the outer circumferential wall of the exterior member 10 to a distance c from the edge of the screw thread 63 to the inner circumferential wall of the exterior member 10 (clearance ratio: d/c in FIG. 1) is set to 50 or more.

On the side downstream of the region defined by the inlet port 16 and the point on the rotor body 61 which is 40 mm in the axial direction (region indicated by B in the drawing), the depth D and the angle of elevation θ of the screw groove 62 are continuously and gradually reduced as the distance from the outlet port 17 is decreased. The degree of this reduction is in proportion to the distance in the axial direction.

Given the distance in the axial direction between predetermined positions P and Q of the screw groove as Lv, and the depth of the screw groove 62 at the respective positions as Dp, Dq, the following expression is satisfied when the degree of reduction in the depth D of the screw groove 62 is in proportion to the distance in the axial direction:

$$Dp-Dq=k\cdot Lv \qquad \text{[Numerical Expression 1]}$$

where k is a constant that is a plus if P is closer to the inlet port than Q is and which is a minus if P is closer to the outlet port than Q is).

Therefore when, for example, the depth of the screw groove at the nearest point to the outlet port side in the region B is T mm and the depth D of the screw groove 62 at a point 1 cm in the axial direction down there is reduced therefrom by t mm, i.e., (T−t) mm, the depth D of the screw groove at a point 3 cm in the axial direction down the nearest point to the outlet port side in the region B is reduced by 3t mm, i.e., (T−3t) mm.

Given the distance in the axial direction between predetermined positions P and Q of the screw groove as Lv, and the angle of elevation of the screw groove 62 at the respective positions as θp, θq, the following expression is satisfied when the degree of reduction in the angle of elevation θ of the screw groove 62 is in proportion to the distance in the axial direction:

$$\theta p-\theta q=k\cdot Lv \qquad \text{[Numerical Expression 2]}$$

where k is a constant that is a plus if P is closer to the inlet port than Q is and which is a minus if P is closer to the outlet port than Q is).

Therefore when, for example, the angle of elevation of the screw groove at the nearest point to the outlet port side in the region B is S° and the angle of elevation of the screw groove 62 at a point 1 cm in the axial direction down there is reduced therefrom by s°, i.e., (S−s)°, the angle of elevation θ of the screw groove at a point 3 cm in the axial direction down the nearest point to the outlet port side in the region B is reduced by 3so, i.e., (S−3s)°.

The screw groove 62 is communicated with the outlet port 17 arranged in a lower part of the exterior member 10, so that the gas transferred through the screw groove 62 is discharged from the outlet port 17. At the outlet port 17, the clearance ratio d/c of the screw groove 62 is 20 or less and the angle of elevation thereof is 10 to 20°.

In the vacuum pump as such, the rotor shaft 18 is rotated at a high speed with the motor 30 to thereby rotate at a high speed the rotor 60 as well. This has process gas or the like in a chamber 90 transferred through the inlet port 16 of the screw groove type vacuum pump and through the screw groove 62 to be discharged from an outlet port 52.

At this point, the pressure in the screw groove 62 is about 0.1 Pa or less in the region defined by the inlet port 16 and the point on the rotor 60 which is 40 mm in the axial direction (the region B), and the depth D and the angle of elevation θ of the screw groove 62 are both set to rather large values. The gas molecules are thus captured at the screw thread 63 efficiently and transferred to the outlet port 17 side without being reflected or flowing backwards.

On the side downstream of the region defined by the inlet port 16 and the point on the rotor 60 which is 40 mm in the axial direction, the pressure in the screw groove 62 is of the viscous flow region. The screw groove here changes sharply and markedly to a shallow groove and comes to have a small angle of elevation θ, which leads to efficient transfer of the captured gas molecules by viscosity to the outlet port 17 while obtaining excellent sealing.

According to this embodiment, the depth D of the screw groove 62 is 20 mm or more and the angle of elevation θ thereof is 20 to 40° at the end on the inlet port 16 side. The intake area of the gas taken in from the inlet port 16 to the screw groove 62 is therefore large, making it easy to introduce the gas into the screw groove.

According to this embodiment, in the region defined by the inlet port 16 and the point on the rotor 60 which is 40 mm in the axial direction (region B) where the pressure is about 0.1 Pa or less, the screw groove 62 has a depth D of 80% or more of the depth at the end on the inlet port 16 side and has a clearance ratio d/c of 50 or more, which together provide the groove 62 with a sufficient depth. In addition, the angle of elevation θ of the groove 62 in the region B is 80% or more of the angle at the end on the inlet port 16 side. Therefore, the gas molecules in the intermediate flow region are captured well at the screw thread 63, and quickly transferred to the outlet port 17 side without flowing backwards.

According to this embodiment, on the side downstream of the region defined by the inlet port 16 and the point on the rotor 60 which is 40 mm in the axial direction, the screw groove changes sharply and markedly to a shallow groove and comes to have a small angle of elevation θ, which leads to efficient transfer of the gas molecules in the molecule flow region by viscosity to the outlet port 17 while obtaining excellent sealing.

According to this embodiment, at the end of the outlet port 17, the depth D of the screw groove 62 is sufficiently shallow, the clearance ratio d/c is 20 or less, and the angle of elevation θ thereof is as sufficiently small as 10 to 20°. The back pressure dependency is thus small, which also is a contributor to obtainment of excellent gas exhaust speed.

Figure 4:
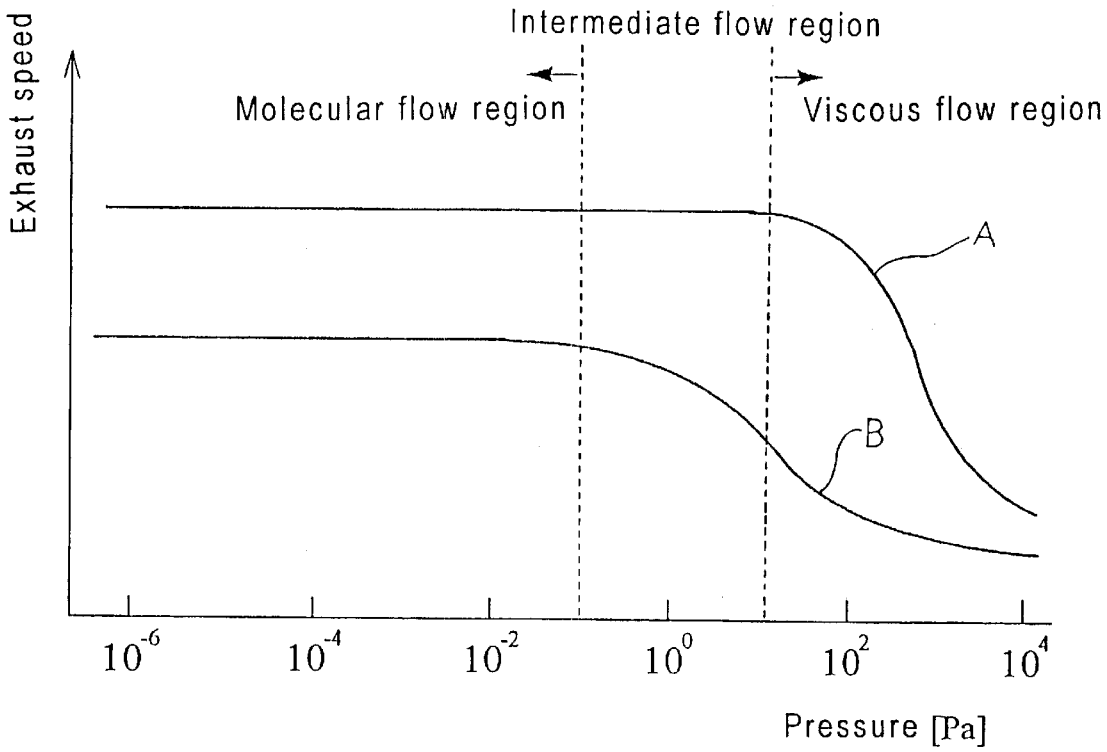
FIG. 4 is a graph showing the relationship between the pressure and the exhaust speed in the screw groove type vacuum pump in FIG. 1, in comparison with a conventional screw groove type vacuum pump.

FIG. 4 is a graph showing the relationship between the pressure and the exhaust speed in the screw groove type vacuum pump according to this embodiment, in comparison with a conventional screw groove type vacuum pump, in which the line A is associated with the screw groove type vacuum pump of this embodiment and the line B is associated with the screw groove type vacuum pump in prior art.

As shown in FIG. 4, in the screw groove type vacuum pump of this embodiment, the depth D and the angle of elevation θ of the screw groove 62 are set to large values in the molecule flow region and the intermediate flow region where the pressure in the screw a groove 62 is 0.1 Pa or less to thereby take in many gas molecules, introduce the gas into the screw groove without reflecting the gas or causing the backward flow of the gas, and transfer the gas molecules to the viscous flow region. Then in the viscous flow region, the depth D and the angle of elevation θ of the screw groove 62 are set to small values to secure the sealing, thereby minimizing the deterioration of the sealing and efficiently transferring the gas molecules from the intermediate flow region. Therefore, an exhaust speed better than in the screw groove type vacuum pump of the prior art can be obtained in any region of the molecule flow region, the intermediate flow region, and the viscous flow region.

The screw groove type vacuum pump structured as above is employed in an embodiment of a vacuum pump system of the present invention in which an auxiliary pump is connected to the outlet port 17.

In the vacuum pump system according to this embodiment, the auxiliary pump may be a well-known one and, as in prior art, is connected to the outlet port 17 of the screw groove type vacuum pump.

In the vacuum pump system according to this embodiment, employment of the screw groove type vacuum pump according to the embodiment previously described makes it possible to fully utilize the capacity of the conventional auxiliary pump, so that the pressure on the outlet port 17 side is adjusted and the discharge capacity of the system is further improved.

The screw groove type vacuum pump of the present invention and the vacuum pump system of the present invention are not limited to the embodiments above, and may be modified suitably as long as the modification does not depart from the spirit of the present invention.

For instance, the depth D of the screw groove 62 of the screw groove type vacuum pump at the end on the inlet port 16 side, which is 20 mm or more in the previous embodiments, may be less than 20 mm. Because the same action and effect as in the previous embodiment can be obtained if the depth D is ¼ or more of the diameter of, including the screw groove 62, the circumferential wall of the rotor on which the screw groove 62 is formed.

The depth D and the angle of elevation θ of the screw groove 62 are both reduced gradually at any point from the end on the inlet port 16 side to the end on the outlet port 17 side in the previous embodiment. However, the depth D and the angle of elevation θ may remain the same at some points along the path, provided that the depth and the angle are not increased at a downstream point from an upstream point. For instance, in the region defined by the inlet port 16 and the point on the rotor 60 which is 40 mm in the axial direction (region B), one of or both of the depth D and the angle of elevation θ may not be reduced but may keep the same value as the depth D and the angle of elevation θ at the end of the inlet port.

In the previous embodiment, the angle of elevation θ of the screw groove 62 is continuously reduced toward the outlet port 17 side in proportion to the distance in the axial direction on the side downstream of the region defined by the inlet port 16 and the point on the rotor body 61 which is 40 mm in the axial direction (region B in the drawing). However, the degree of this reduction may be in logarithmic proportion to the distance in the axial direction, instead. If the degree of reduction in the angle of elevation θ of the screw groove 62 is in logarithmic proportion to the distance in the axial direction, the angle of elevation θ is sharply reduced as the screw groove approaches the outlet port 17, avoiding the influence of the back pressure even more effectively.

Though the screw groove 62 is formed on the rotor 60 in the previous embodiment, the groove may be formed on the surface of the exterior member 10 which is opposite to the rotor.

In the screw groove type vacuum pump according to the previous embodiment, the screw groove 62 is formed on the outer peripheral surface of the rotor 60 and the gas is transferred through a space between the screw groove 62 and an outer tube member that is a stator member arranged outside the groove. Alternatively, for example, an outer rotor type motor may be used to arrange the stator member inside the rotor 60 and form the screw groove 62 on the inner peripheral surface of the rotor 60 or on the outer peripheral surface of the stator member.

The same effect can be obtained in a complex vacuum pump in which the screw groove type vacuum pump according to the previous embodiment or according to the modified examples described above and a vacuum pump other than the screw groove type vacuum pump, such as a turbomolecular pump or a centrifugal flow type pump, are connected. The same effect also can be obtained in a vacuum pump system in which an auxiliary pump is provided in addition to this complex vacuum pump.

As has been described, according to the screw groove type vacuum pump, the complex vacuum pump and the vacuum pump system of the present invention, the intake area of the gas that is taken from the inlet port into the screw groove is large and the gas is hardly reflected, so that the gas is efficiently introduced from the inlet port into the screw groove and the introduced gas is transferred to the outlet port with excellent sealing properties. A high exhaust speed thus can be obtained.

What is claimed is:

1. A screw groove-type vacuum pump comprising: a rotor member mounted for undergoing rotation; a stator member coaxial with the rotor member and having a peripheral wall disposed opposite to and spaced-apart from a circumferential wall of the rotor member; an inlet port for introducing gas into a space between the circumferential wall of the rotor member and the peripheral wall of the stator member; an outlet port for discharging gas introduced into the space between the circumferential wall of the rotor member and the peripheral wall of the stator member; and a screw groove formed on one of the circumferential wall of the rotor member and the peripheral wall of the stator member for transferring gas introduced into the inlet port through the space between the circumferential wall of the rotor member and the peripheral wall of the stator member and to the outlet port during rotation of the rotor member; wherein a depth of the screw groove at a point thereof which is nearest the inlet port is 20 mm or more and decreases toward the outlet port from the inlet port, the depth of the screw groove in a given region defined between the point of the screw groove nearest the inlet port and a point on the rotor member disposed in an axial direction thereof at a distance of 40 mm from the point of the screw groove nearest the inlet port being 80% or more of the depth of the screw groove at the point thereof nearest the inlet port; and wherein an angle of elevation of the screw groove with respect to a radial axis of the rotor member decreases toward the outlet port from the inlet port, and the angle of elevation of the screw groove in the given region is 80% or more of the angle of elevation of the screw groove at the point thereof nearest the inlet port.

2. A screw groove-type vacuum pump as claimed in claim 1; wherein the depth of the screw groove decreases toward the outlet port in proportion to the distance of the screw groove in the axial direction.

3. A screw groove-type vacuum pump as claimed in claim 1; wherein the angle of elevation of the screw groove decreases toward the outlet port in proportion to the distance of the screw groove in the axial direction.

4. A screw groove-type vacuum pump as claimed in claim 1; wherein the angle of elevation of the screw groove decreases toward the outlet port in logarithmic proportion to the distance of the screw groove in the axial direction.

5. A complex vacuum pump comprising a screw groove-type vacuum pump as claimed in claim 1.

6. A vacuum pump system comprising: a complex vacuum pump as claimed in claim 5; and an auxiliary pump connected to the outlet port of the screw groove-type vacuum pump for taking in gas discharged through the outlet port of the screw groove-type vacuum pump.

7. A vacuum pump system comprising: a screw groove-type vacuum pump as claimed in claim 1; and an auxiliary pump connected to the outlet port of the screw groove-type vacuum pump for taking in gas discharged through the outlet port.

8. A screw groove-type vacuum pump comprising: a rotor member mounted for undergoing rotation; a stator member coaxial with the rotor member and having a peripheral wall disposed opposite to and spaced-apart from a circumferential wall of the rotor member; an inlet port for introducing gas into a space between the circumferential wall of the rotor member and the peripheral wall of the stator member; an outlet port for discharging gas introduced into the space between the circumferential wall of the rotor member and the peripheral wall of the stator member; and a screw groove formed on one of the circumferential wall of the rotor member and the peripheral wall of the stator member for transferring gas introduced into the inlet port through the space between the circumferential wall of the rotor member and the peripheral wall of the stator member and to the outlet port during rotation of the rotor member; wherein a depth of the screw groove decreases toward the outlet port from the inlet port, the depth of the screw groove at a point thereof which is nearest the inlet port being equal to or larger than ¼ the diameter of one of the circumferential wall of the rotor member and the peripheral wall of the stator member, and the depth of the screw groove in a given region defined between the point of the screw groove nearest the inlet port and a point on the rotor member disposed in an axial direction thereof at a distance of 40 mm from the point of the screw groove nearest the inlet port being 80% or more of the depth of the screw groove at the point thereof nearest the inlet port; and wherein an angle of elevation of the screw groove with respect to a radial axis of the rotor member decreases toward the outlet port from the inlet port, and the angle of elevation of the screw groove in the given region is 80% or more of the angle of elevation of the screw groove at the point thereof nearest the inlet port.

9. A screw groove-type vacuum pump as claimed in claim 8; wherein the depth of the screw groove decreases toward the outlet port in proportion to the distance of the screw groove in the axial direction.

10. A screw groove-type vacuum pump as claimed in claim 8; wherein the angle of elevation of the screw groove decreases toward the outlet port in proportion to the distance of the screw groove in the axial direction.

11. A screw groove-type vacuum pump as claimed in claim 8; wherein the angle of elevation of the screw groove decreases toward the outlet port in logarithmic proportion to the distance of the screw groove in the axial direction.

12. A complex vacuum pump comprising a screw groove-type vacuum pump as claimed in claim 8.

13. A vacuum pump system comprising: a complex vacuum pump as claimed in claim 12; and an auxiliary pump connected to the outlet port of the screw groove-type vacuum pump for taking in gas discharged through the outlet port of the screw groove-type vacuum pump.

14. A vacuum pump system comprising: a screw groove-type vacuum pump as claimed in claim 8; and an auxiliary pump connected to the outlet port of the screw groove-type vacuum pump for taking in gas discharged through the outlet port.

15. A screw groove-type vacuum pump comprising: a casing having an inlet port into which a gas is introduced and an outlet port from which the gas is discharged; a rotor member rotatably received in the casing so that a first axial end of the rotor member is disposed proximate the inlet port and a second axial end opposite the first axial end is disposed proximate the outlet port; a motor disposed in the casing for rotatably driving the rotor member; a stator member disposed in the casing and having a peripheral wall disposed opposite to and spaced-apart from a peripheral wall of the rotor member; and a screw groove formed on one of the peripheral wall of the rotor member and the peripheral wall of the stator member so that rotational movement of the rotor member causes a gas introduced at the inlet port to be transported by the screw groove in an axial direction of the rotor member away from the inlet port and toward the outlet port; wherein a depth of the screw groove at a point thereof which is nearest the inlet port is equal to or larger than ¼ the diameter of one of the peripheral wall of the rotor member and the peripheral wall of the stator member.

16. A screw groove-type vacuum pump as claimed in claim 15; wherein the depth of the screw groove in a given region defined between the point of the screw groove nearest the inlet port and a point on the rotor member disposed in an axial direction thereof at a distance of 40 mm from the point of the screw groove nearest the inlet port is 80% or more of the depth of the screw groove at the point thereof nearest the inlet port.

17. A screw groove-type vacuum pump as claimed in claim 16; wherein an angle of elevation of the screw groove with respect to a radial axis of the rotor member decreases toward the outlet port from the inlet port; and wherein the angle of elevation of the screw groove in the given region is 80% or more of the angle of elevation of the screw groove at the point thereof nearest the inlet port.

18. A screw groove-type vacuum pump as claimed in claim 17; wherein the angle of elevation of the screw groove decreases toward the outlet port in proportion to the distance of the screw groove in the axial direction.

19. A screw groove-type vacuum pump as claimed in claim 17; wherein the angle of elevation of the screw groove decreases toward the outlet port in logarithmic proportion to the distance of the screw groove in the axial direction.

20. A screw groove-type vacuum pump as claimed in claim 15; wherein the depth of the screw groove decreases toward the outlet port in proportion to the distance of the screw groove in the axial direction.

21. A complex vacuum pump comprising a screw groove-type vacuum pump as claimed in claim 15.

22. A vacuum pump system comprising: a complex vacuum pump as claimed in claim 21; and an auxiliary pump connected to the outlet port of the screw groove-type vacuum pump for taking in gas discharged through the outlet port of the screw groove-type vacuum pump.

23. A vacuum pump system comprising: a screw groove-type vacuum pump as claimed in claim 15; and an auxiliary pump connected to the outlet port of the screw groove-type vacuum pump for taking in gas discharged through the outlet port.

24. A screw groove-type vacuum pump comprising: a casing having an inlet port into which a gas is introduced and an outlet port from which the gas is discharged; a rotor member rotatably received in the casing so that a first axial end of the rotor member is disposed proximate the inlet port and a second axial end opposite the first is disposed proximate the outlet port; a motor disposed in the casing for rotatably driving the rotor member; a stator member disposed in the casing and having a peripheral wall disposed opposite to and spaced-apart from a peripheral wall of the rotor member; and a screw groove formed on one of the peripheral wall of the rotor member and the peripheral wall of the stator member so that rotational movement of the rotor member causes a gas introduced at the inlet port to be transported by the screw grooves in an axial direction of the rotor member away from the inlet port and toward the outlet port; wherein a depth of the screw groove at a point thereof which is nearest the inlet port is 20 mm or more.

25. A screw groove-type vacuum pump as claimed in claim 24; wherein the depth of the screw groove in a given region defined between the point of the screw groove nearest the inlet port and a point on the rotor member disposed in an axial direction thereof at a distance of 40 mm from the point of the screw groove nearest the inlet port is 80% or more of the depth of the screw groove at the point thereof nearest the inlet port.

26. A screw groove-type vacuum pump as claimed in claim 25; wherein an angle of elevation of the screw groove with respect to a radial axis of the rotor member decreases toward the outlet port from the inlet port; and wherein the angle of elevation of the screw groove in the given region is 80% or more of the angle of elevation of the screw groove at the point thereof nearest the inlet port.

27. A screw groove-type vacuum pump as claimed in claim 26; wherein the angle of elevation of the screw groove decreases toward the outlet port in proportion to the distance of the screw groove in the axial direction.

28. A screw groove-type vacuum pump as claimed in claim 26; wherein the angle of elevation of the screw groove decreases toward the outlet port in logarithmic proportion to the distance of the screw groove in the axial direction.

29. A screw groove-type vacuum pump as claimed in claim 24; wherein the depth of the screw groove decreases toward the outlet port in proportion to the distance of the screw groove in the axial direction.

30. A complex vacuum pump comprising a screw groove-type vacuum pump as claimed in claim 24.

31. A vacuum pump system comprising: a complex vacuum pump as claimed in claim 30; and an auxiliary pump connected to the outlet port of the screw groove-type vacuum pump for taking in gas discharged through the outlet port of the screw groove-type vacuum pump.

32. A vacuum pump system comprising: a screw groove-type vacuum pump as claimed in claim 24; and an auxiliary pump connected to the outlet port of the screw groove-type vacuum pump for taking in gas discharged through the outlet port.

* * * * *